US011167344B2

(12) United States Patent
Boindecker

(10) Patent No.: US 11,167,344 B2
(45) Date of Patent: Nov. 9, 2021

(54) METHOD FOR PRODUCING A CAST WORKPIECE

(71) Applicant: Fill Gesellschaft m.b.H., Gurten (AT)

(72) Inventor: Alois Boindecker, Gurten (AT)

(73) Assignee: Fill Gesellschaft m.b.H., Gurten (AT)

( * ) Notice: Subject to any disclaimer, the term of this patent is extended or adjusted under 35 U.S.C. 154(b) by 0 days.

(21) Appl. No.: 16/645,115

(22) PCT Filed: Sep. 4, 2018

(86) PCT No.: PCT/AT2018/060198
§ 371 (c)(1),
(2) Date: Mar. 19, 2020

(87) PCT Pub. No.: WO2019/046874
PCT Pub. Date: Mar. 14, 2019

(65) Prior Publication Data

US 2021/0129215 A1 May 6, 2021

(30) Foreign Application Priority Data

Sep. 7, 2017 (AT) ..... A50752/2017

(51) Int. Cl.
*B22D 29/00* (2006.01)
*B22C 9/10* (2006.01)
(Continued)

(52) U.S. Cl.
CPC ..... *B22D 29/005* (2013.01); *B22C 9/10* (2013.01); *B22C 9/02* (2013.01); *B22D 31/002* (2013.01)

(58) Field of Classification Search
CPC .... B22D 31/002; B22D 29/00; B22D 29/001; B22D 29/005; B22D 23/003; B22D 27/00;
(Continued)

(56) References Cited

U.S. PATENT DOCUMENTS 4,643,243 A * 2/1987 McKibben ..... B22D 31/002 164/260
2006/0000571 A1* 1/2006 Crafton ..... B22D 47/00 164/70.1
2007/0137825 A1 6/2007 Kato et al.

FOREIGN PATENT DOCUMENTS

CN 203495196 U 3/2014
DE 36 37 367 A1 6/1987
(Continued)

OTHER PUBLICATIONS

English Machine Translation of Boindecker et al. (WO 2016/201474) (Year: 2016).*
(Continued)

*Primary Examiner* — Kevin P Kerns
*Assistant Examiner* — Steven S Ha
(74) *Attorney, Agent, or Firm* — Collard & Roe, P.C.

(57) ABSTRACT

A method for producing a cast workpiece includes the following method steps: providing a mold having at least one mold core arranged in the mold; inserting a metal melt into the mold; waiting for a period of time until at least the outer contour of the metal melt has solidified and the workpiece has been formed from the metal melt; removing the workpiece from the mold; shattering the mold core, wherein this method step is carried out before the workpiece has entirely cooled down from the casting process. For shattering the mold core, a hammer head is applied on a defined energy transmission surface of the workpiece and the energy transmission surface is acted on, in particular hit on, by the hammer head.

21 Claims, 5 Drawing Sheets

Figure 1:
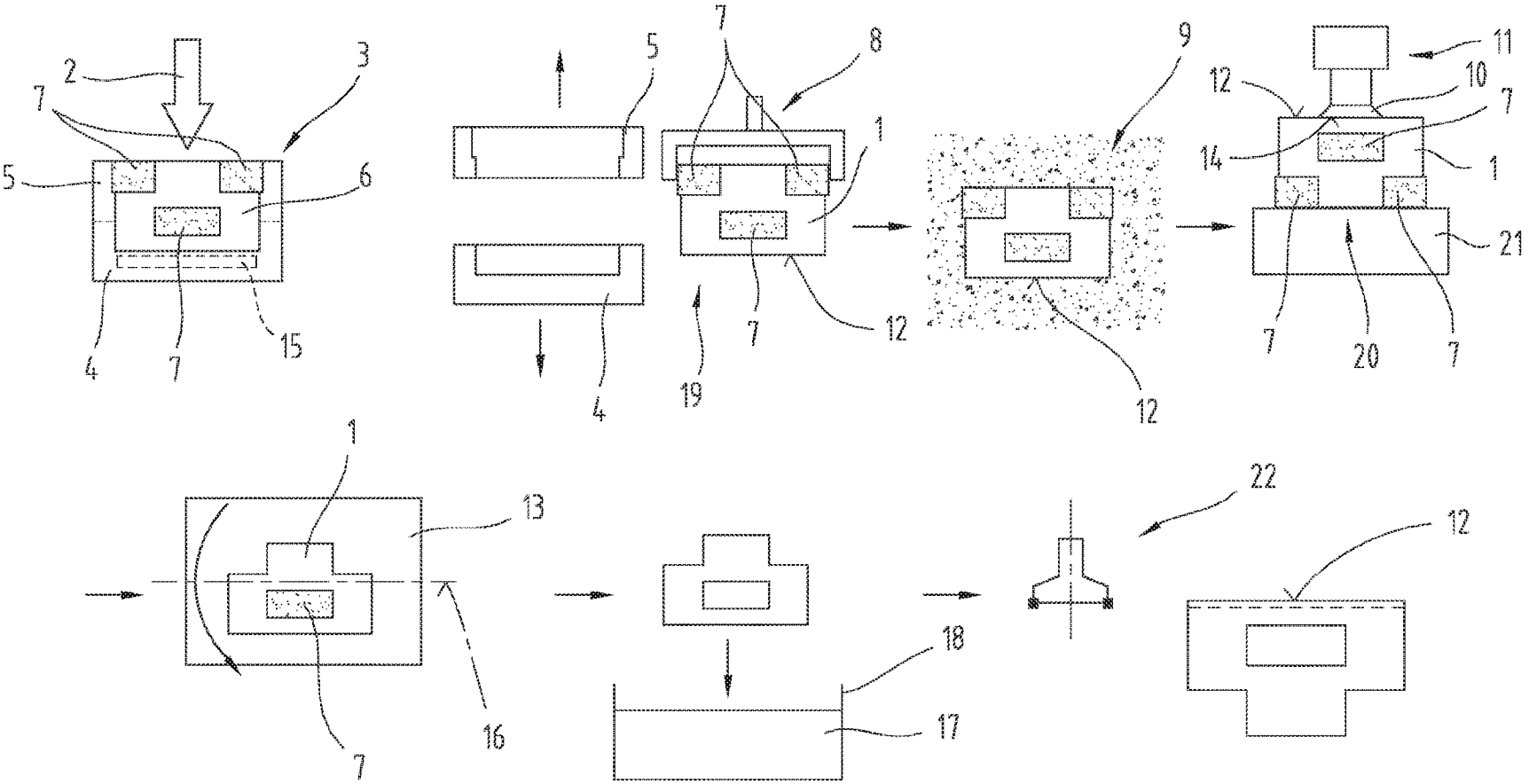

(51) Int. Cl.
*B22C 9/02* (2006.01)
*B22D 31/00* (2006.01)

(58) Field of Classification Search
CPC ..... B22D 27/04; B22D 27/045; B22C 9/00; B22C 9/02; B22C 9/10
See application file for complete search history.

(56) References Cited

FOREIGN PATENT DOCUMENTS

| | | | | |
|---|---|---|---|---|
| DE | 102010054496 | A1 * | 6/2012 | ..... H02K 15/00 |
| DE | 10 2014 221 897 | A1 | 4/2016 | |
| EP | 0 304 683 | A2 | 3/1989 | |
| EP | 1 721 689 | A1 | 11/2006 | |
| FR | 2 954 195 | A1 | 6/2011 | |
| GB | 2 348 839 | A | 10/2000 | |
| JP | 2000-024772 | A | 1/2000 | |
| JP | 2012-024839 | A | 2/2012 | |
| WO | 2016/201474 | A1 | 12/2016 | |
| WO | 2017/208065 | A1 | 12/2017 | |

OTHER PUBLICATIONS

English Machine Translation of Hebras et al. (FR 2954195) (Year: 2011).*
International Search Report in PCT/AT2018/060198, dated Nov. 30, 2018.

* cited by examiner

METHOD FOR PRODUCING A CAST WORKPIECE

CROSS REFERENCE TO RELATED APPLICATIONS

This application is the National Stage of PCT/AT2018/060198 filed on Sep. 4, 2018, which claims priority under 35 U.S.C. § 119 of Austrian Application No. A50752/2017 filed on Sep. 7, 2017, the disclosure of which is incorporated by reference. The international application under PCT article 21(2) was not published in English.

The invention relates to a method for producing a cast workpiece.

When workpieces are produced in casting processes, usually, a metal melt, for example an aluminum melt, is inserted into molds. The terms metal melts in this document covers not only liquid but also thixotropic metal melts. After solidification and cooling of the metal melt, the workpiece is demolded, and a mold core located in the workpiece is shattered. In usual methods it was common to cool the workpieces to a temperature of approx. 80° C. before the cores were removed from these. Removal of the core is carried out at a relatively low temperature since at this point in time the structure of the workpiece is essentially not subjected to any further changes.

Methods in which the removal of the core is carried out at an increased temperature are known from WO 2016/201474 A1, as well as from EP 1 721 689 A1. However, since the heated material structure of the workpiece has a lower solidity in this state, the workpiece can be damaged.

It is the object of the present invention to create a method in which the efficiency in the production of cast workpieces can be increased and in which the workpiece is not damaged.

This object is achieved by means of a method according to the claims.

According to the invention, a method for producing a cast workpiece is provided, wherein the method comprises the following method steps:

- providing a mold with at least one mold core arranged in the mold;
- inserting a metal melt into the mold;
- waiting for a period of time, until at least the outer contour of the metal melt has solidified and the workpiece is formed from the metal melt;
- removing the workpiece from the mold;
- shattering the mold core, wherein this method step is carried out before the workpiece has entirely cooled down from the casting process.

For shattering the mold core, a hammer head is applied on a defined energy transmission surface of the workpiece and the energy transmission surface is acted on, in particular hit on, by means of the hammer head.

The method according to the invention entails the surprising advantage that shattering the mold core can be carried out at an increased process temperature and the process can thus be further optimized. As opposed to the prior art, an energy transmission surface of the workpiece, on which a hammer head is placed for shattering the mold core, is predetermined. Hence, the energy transmission surface can be designed such that it has a higher solidity than the other surfaces and/or that potential deformation on the energy transmission surface can be removed in subsequent processing steps. Thus, it is possible that the mold core is shattered at a higher core temperature than possible in the methods known from the prior art. The surface of the workpiece that is to serve as energy transmission surface can already be determined during construction of the workpiece and/or during simulation of the casting process. Moreover, it is also conceivable that it is determined in tests which surface is best suited as energy transmission surface. It is advantageous if it is determined in a working instruction which surface of the workpiece can and/or may serve as energy transmission surface.

Moreover, it can be useful if the energy transmission surface is a surface of the workpiece which is mechanically processed, in particular chipped, in subsequent production steps. The advantage of this is that potential damage and/or plastic deformations of the energy transmission surface, which are applied into it during the process of shattering, can be removed in subsequent method steps.

It can further be provided for that a surface of the workpiece serves as the energy transmission surface which has the largest surface solidity at the point in time at which the mold core is shattered. The advantage of this is that by this measure, the deformation of the workpiece during the process of shattering the mold core is kept as low as possible.

In addition to this, it can be provided for that a surface of the workpiece serves as the energy transmission surface which was arranged in the region of a lower part of the mold, in particular at a bottom side of the workpiece with respect to the casting position, during the casting process, in particular during the gravity casting process. The advantage of this is that, with respect to the casting position, the lower region of the workpiece solidifies first and thus has the higher surface solidity. This results from the fact that the melt inserted into the mold is calmed first in this region and comes into contact with the cooling mold first.

In particular, it is useful that the energy transmission surface is located where the melt is calmed first.

An embodiment, according to which it can be provided for that the workpiece is turned by 180° after removal from the mold such that the energy transmission surface is located on the upper side of the workpiece and the workpiece rests on a support table on a support side opposite to the energy transmission surface, is also advantageous. By this measure, the hammer head of the decoring hammer can act on the workpiece in vertical direction from the top. In the course of this, the workpiece can be placed on the support table.

According to a further embodiment, it is possible that the workpiece is designed as a cylinder head blank for further processing into a cylinder head for a combustion engine, wherein an engine block connecting surface of the cylinder head blank serves as the energy transmission surface. In particular for cylinder heads, removing the core at high temperatures entails large economic advantages. Determining the engine block connecting surface as energy transmission surface entails the advantage that the engine block connecting surface can on the hand be positioned at the bottom during the casting process and on the hand is milled off in subsequent processing steps. Hence, on the hand, the deformation on the engine block connecting surface during shattering of the core can be kept as low as possible. On the other hand, the applied deformations can be removed in subsequent processing steps such that no application traces are present on the finished cylinder head. In this regard, it is particularly advantageous that the engine block connecting surface of the cylinder head must be processed anyway in order to obtain a plane surface. A further advantage in the use of the engine block connecting surface as energy transmission surface consists in that it is a surface which is formed planar and has a large surface area. Thus, the applied force can be distributed over a large surface, thus keeping the surface pressure as low as possible.

Moreover, it can be useful if the energy transmission surface is formed as a planar surface. The advantage of this is that the hammer head can also have a planar surface and thus rest against the full surface of the energy transmission surface of the workpiece.

In addition to this, it can be provided for that a surface area of an application surface of the hammer head or of the load distribution plate, which rests against the energy transmission surface during shattering of the mold core, amounts to between 150% and 10%, in particular between 110% and 50%, preferably between 100% and 80%, of a surface area of the energy transmission surface. In this regard, it is of advantage that by this area dimensioning a surface pressure that is as low as possible can be achieved.

It can further be provided for that the workpiece is removed from the mold at a surface temperature of the energy transmission surface of between 440° Celsius and 360° Celsius. The advantage of this is that at this temperature the workpiece already has a sufficient solidity to be manipulated.

Moreover, it can be provided for that the workpiece is further cooled down in the ambiance while the workpiece is fed to a hammer head for shattering the mold core until the energy transmission surface has a surface temperature of between 300° Celsius and 400° Celsius. A workpiece having a temperature in the indicated range at the energy transmission surface already has a sufficient solidity to allow for the energy transmission surface to be acted upon by means of the hammer head.

It can further be provided for that shattering the mold core by means of the hammer head is carried out at a surface temperature of the energy transmission surface of between 300° Celsius and 400° Celsius, wherein at least outward parts of the mold core are shattered. In particular, it can be provided for that in this processing step, only outward parts or parts close to edges of the mold core are shattered, in particular interspersed with cracks, and thus fall off the workpiece. Thereby, the outer surface of the workpiece can be released from the mold cores such that the workpiece can cool down more quickly. Even if the outward mold cores are not completely removed or chipped off the workpiece, but only detach from the workpiece surface, the cooling effect can be improved.

Moreover, it can be provided for that in the method step described above, the hammer head acts on the workpiece with a striking action for between 1 second and 20 seconds.

Further, it can be provided for that after shattering at least of parts of the mold core, the workpiece is further cooled down until the energy transmission surface has a surface temperature of between 100° Celsius and 200° Celsius, in particular between 150° Celsius and 200° Celsius, and that the workpiece is subsequently again fed to a hammer head for shattering of the mold core, wherein in the course of this, the remaining parts, in particular the parts located on the inside of the workpiece, of the mold core are shattered as well. The advantage of this is that in this method step also those parts of the mold core can be shattered which are arranged within the workpiece.

According to a particular embodiment, it is possible that the workpiece is clamped in a vibrator device after shattering of the mold core and the workpiece is rotated about at least one horizontal axis of rotation during simultaneous vibration. The advantage of this is that by this measure the mold core can be further shattered and/or that in this method step the shattered mold core parts can be removed from the workpiece.

According to an advantageous further embodiment, it can be provided for that during shattering of the mold core, several hammer heads simultaneously act on the energy transmission surface. The advantage of this is that the required energy can be introduced into the workpiece by several hammer heads at the same time.

In particular, it can be advantageous if a load distribution plate is inserted between the hammer head and the energy transmission surface. The advantage of this is that by the load distribution plate the surface pressure on the energy transmission surface can be kept as low as possible.

Moreover, it can be provided for that a cooling channel is formed in the mold, at least in the region in which the energy transmission surface of the workpiece is formed, wherein the workpiece is cooled in the region of the energy transmission surface by means of the cooling channel. The advantage of this is that the energy transmission surface can be cooled by means of the cooling channel and it can hence have a comparatively high surface solidity with respect to the rest of the workpiece.

Moreover, it can be provided for that the energy transmission surface is locally cooled down after removal of the workpiece from the mold, for example by the energy transmission surface of the workpiece being plunged into a coolant. Thereby, the energy transmission surface can have a high solidity, while the rest of the workpiece can be kept at a high temperature level.

According to the invention, a decoring hammer carrier for shattering the mold core of a cast workpiece is provided, wherein the decoring hammer carrier has at least one decoring hammer having a hammer head. Moreover, a load distribution plate is provided, which can be brought between the hammer head and the workpiece. The advantage of this is that the load distribution plate can serve to prevent high surface pressure being applied to the workpiece.

Moreover, it can be provided for that the load distribution plate is coupled to at least two hammer heads of two decoring hammers. The advantage of this is that the hammer heads of the two decoring hammer are coupled to one another by this measure.

It can further be provided for that the load distribution plate is detachably coupled to the hammer heads of the decoring hammers. Thereby, different load distribution plates can be provided for different workpieces, wherein the load distribution plates can be exchanged selectively.

In particular, it can be provided for that the contour of the load distribution plate is adapted to the surface contour of the energy transmission surface of the workpiece.

Moreover, it can be provided for that the load distribution plate has a flexible surface condition in every region in which it rests against the energy transmission surface of the workpiece. Thereby, the load distribution plate can flexibly adapt to the energy transmission surface of the workpiece.

Moreover, it can be provided for that the feeder of the workpiece comprises the energy transmission surface. In particular, this measure can be useful if a sand mold serves as the mold. In this regard, the mold has an insulating effect such that the workpiece cannot cool down. If the energy transmission surface on the feeder is selected, the sand mold can be chipped off the workpiece to facilitate cooling of the workpiece.

Moreover, it is also conceivable that during shattering of the mold core, not only the mold core and/or outward mold core parts are removed from the workpiece, but that elements introduced into the mold core and/or the mold, such as chill iron, are removed as well.

It can further be provided for that the hammer head is pressed against the energy transmission surface such during the process of shattering the mold core that it continuously rests against the energy transmission surface of the workpiece also in case of a positional displacement. In other words, it is hence prevented that the hammer head lifts off the energy transmission surface of the workpiece during the process of shattering the mold core. Thereby, it can be prevented that a stroke is applied to the energy transmission surface and it is damaged. A positional displacement of the energy transmission surface in particular occurs if the workpiece lies on the support table such that an outward mold core, which is shattered, lies on the support table. Due to the shattering of the outward mold core, a positional displacement of the workpiece occurs.

Moreover, it can be useful if the decoring hammer is designed as a hydraulic hammer. The advantage of this is that a hydraulic hammer can be controlled such that the hammer head continuously lies against the energy transmission surface of the workpiece and no striking on the workpiece occurs.

It can further be provided for that during shattering of the mold core, the hammer head is constantly pressed against the energy transmission surface of the workpiece with a pressure force between 100 N and 2,000 N, in particular between 200 N and 700 N.

Moreover, it can be provided for that the workpiece is formed as a hollow-cylindrical electric motor housing blank for further processing to an electric motor housing, wherein an end face of the hollow-cylindrical electric motor housing blank serves as the energy transmission surface. The advantage of this is that the end face of the hollow-cylindrical electric motor housing blank is in further consequence mechanically processes. Moreover, the end face can have a comparatively high solidity, since it can solidify sooner.

The mold core preferably is a structure, which is formed of sand and after the removal of which from the workpiece, cavities and/or clearances can be formed in the workpiece. In particular, it can be provided for that the sand of the mold core obtains its form stability by means of a binder. The mold core can consist of several parts which can be connected to one another or which can be arranged at different positions in the mold independently from one another. Moreover, it can be provided for that the mold core is also partly arranged on the outside of the workpiece, and/or that the mold core partly projects beyond the workpiece outwardly. Such an outward mold core can for example be arranged in the region of the feeder or of the sprue.

The method step "shattering the mold core" is to be understood as a method step in which the mold core at least partly breaks. This method step does not contain the removal of the mold core from the workpiece.

A cylinder head blank is a cast workpiece from which a cylinder head for a combustion engine is produced by mechanical finishing, such as milling. The finished cylinder head is placed on an engine block of the combustion engine. Thus, the cylinder head comprises an engine block connecting surface, which, optionally with interposition of the cylinder head gasket, rests against the cylinder block in the built-in state. The surface on the cylinder head blank that serves as the raw surface for the engine block connecting surface of the cylinder head is referred to as the engine block connecting surface of the cylinder head blank. The cylinder head blank thus per definition also comprises an engine block connecting surface, wherein it must first be mechanically processed in order to actually be brought into contact with the engine block.

The term casting position of the workpiece refers to the spatial orientation and/or position in which the workpiece lies as long as it is held in the mold. This applies to gravity casting methods in which the mold is not moved. In tilt casting or rotational casting methods, the casting position is understood to be the final position of the mold.

For the purpose of better understanding of the invention, it will be elucidated in more detail by means of the figures below.

Figure 3:
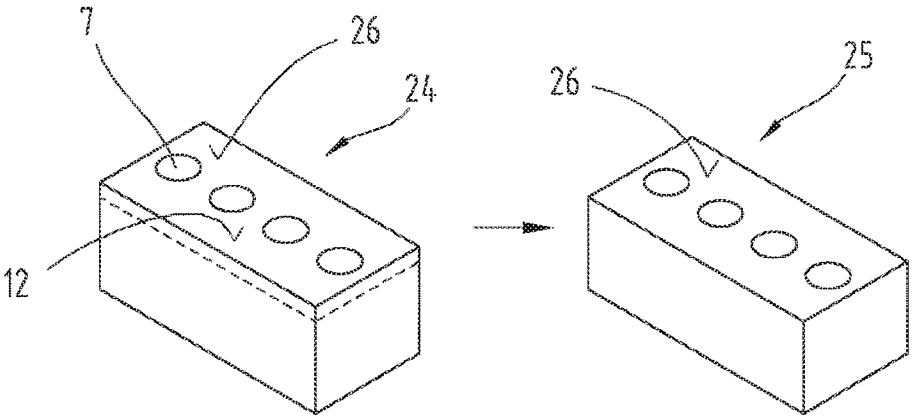
Figure 2:
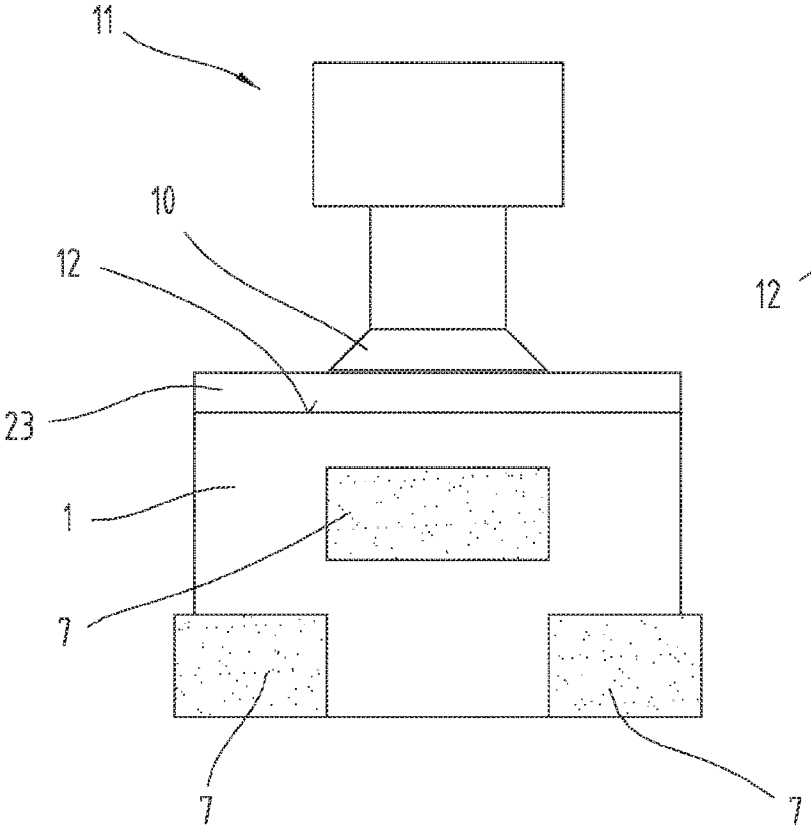
Figure 4:
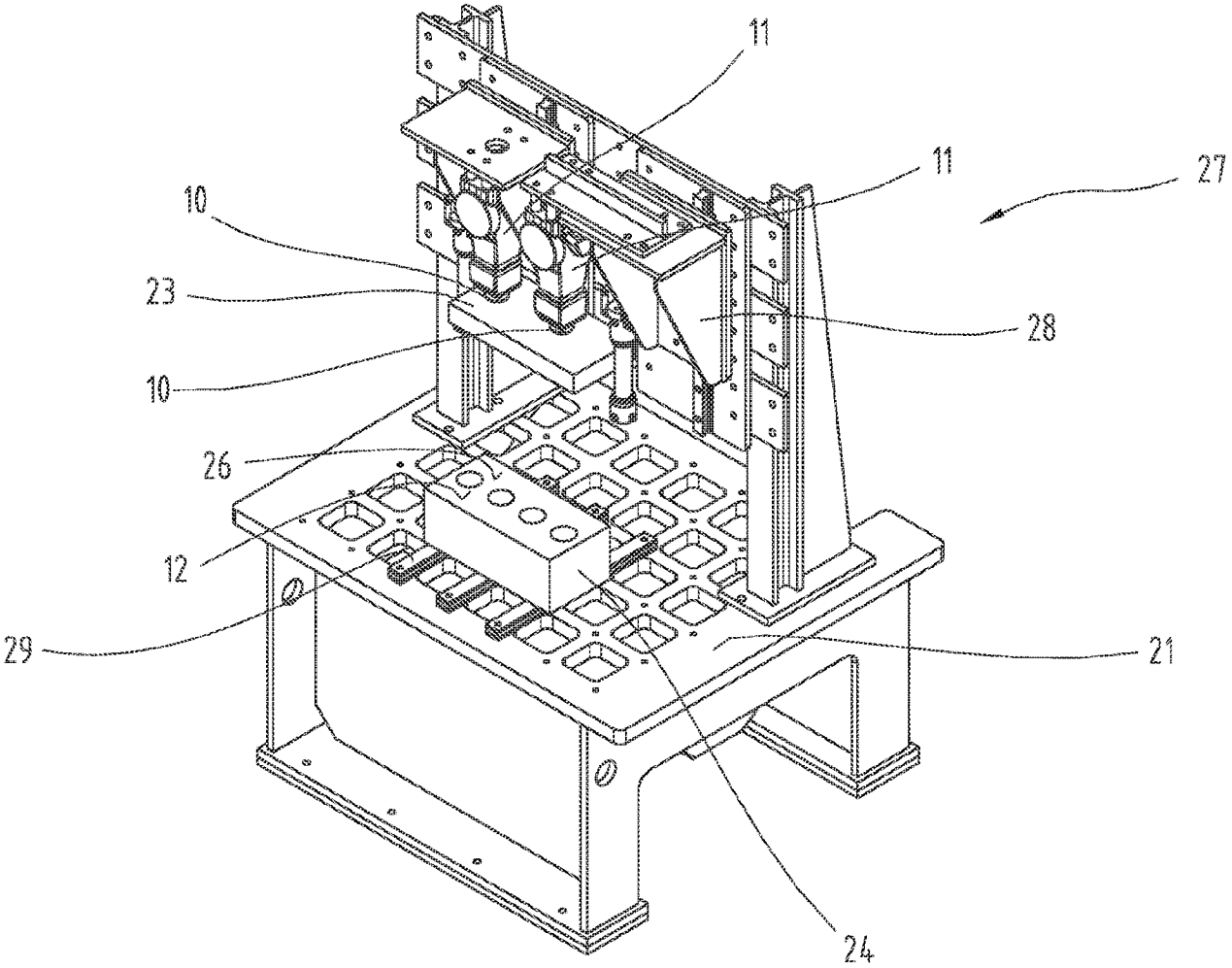
Figure 5:
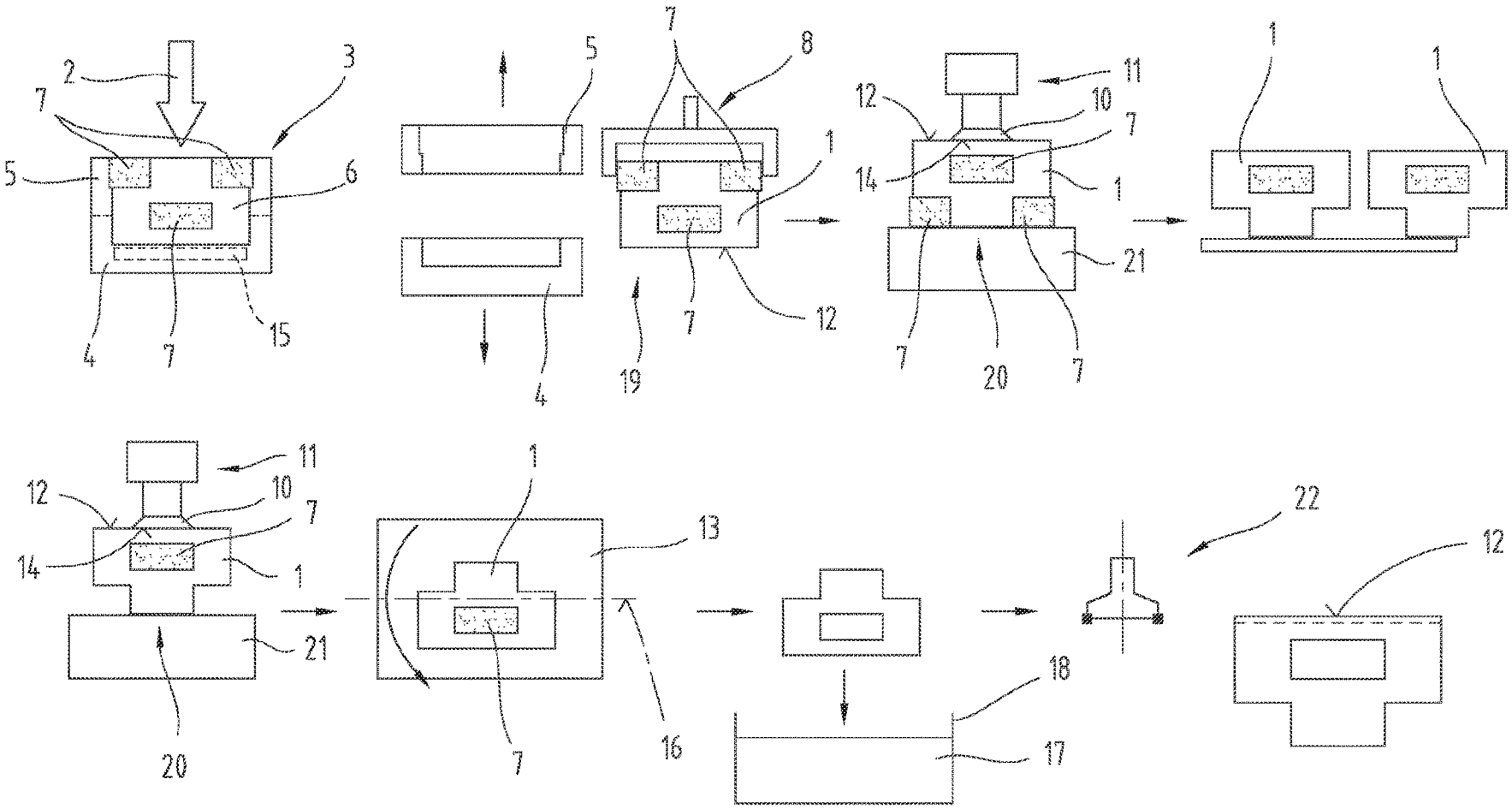
Figure 6:
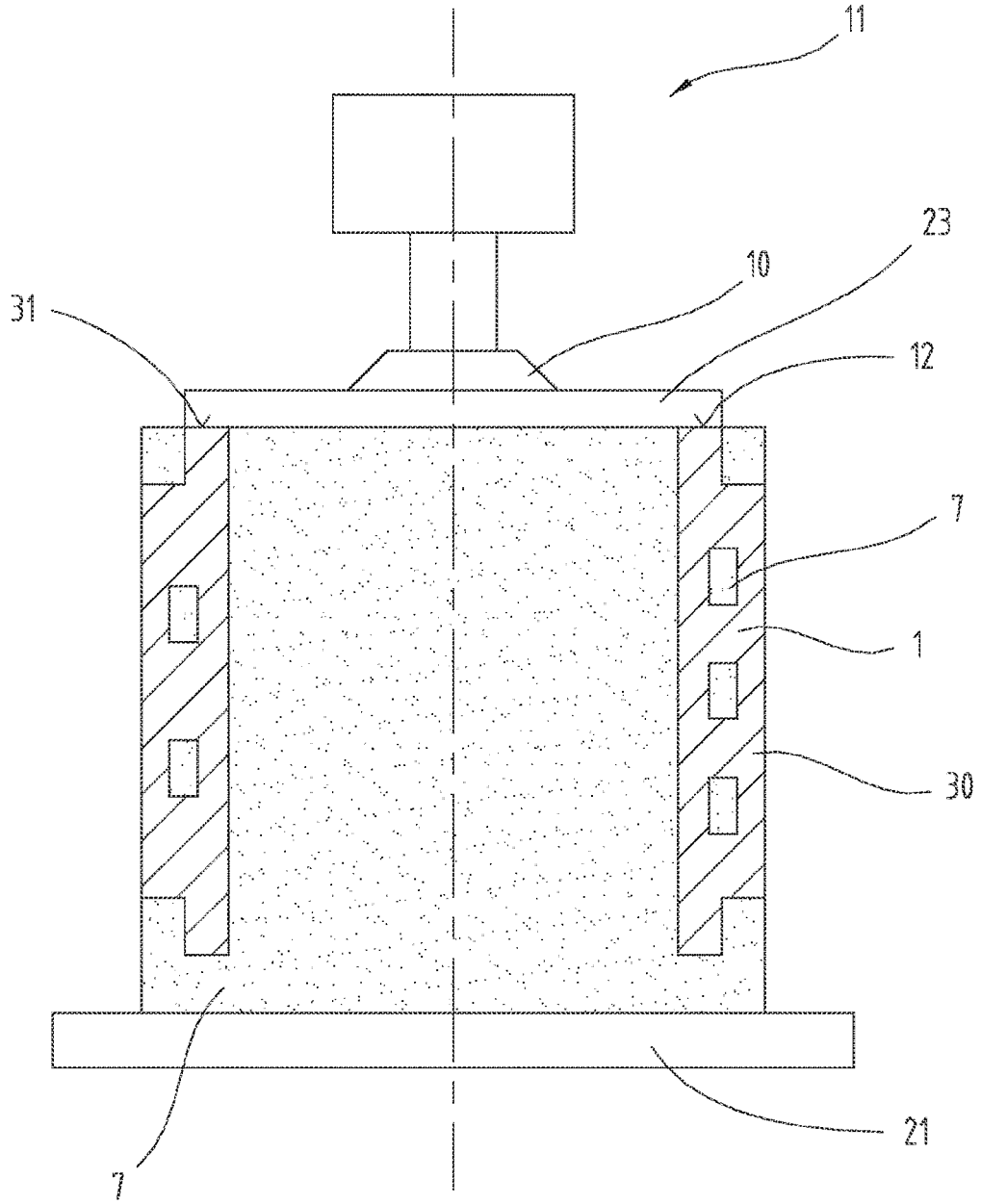

These show in a respectively very simplified schematic representation:

FIG. 1 a flow chart of an exemplary embodiment of the method for producing a cast workpiece;

FIG. 2 a schematic representation of a cast workpiece with a decoring hammer and a load distribution plate;

FIG. 3 a schematic representation of a cylinder head blank and a cylinder head;

FIG. 4 a cylinder head blank in a decoring device;

FIG. 5 a flow chart of a further exemplary embodiment of the method for producing a cast workpiece;

FIG. 6 a further exemplary embodiment of a workpiece, which is formed as a housing for an electric motor.

First of all, it is to be noted that in the different embodiments described, equal parts are provided with equal reference numbers and/or equal component designations, where the disclosures contained in the entire description may be analogously transferred to equal parts with equal reference numbers and/or equal component designations. Moreover, the specifications of location, such as at the top, at the bottom, at the side, chosen in the description refer to the directly described and depicted figure and in case of a change of position, these specifications of location are to be analogously transferred to the new position.

According to FIG. 1, in a method for producing a cast workpiece 1 according to the invention a metal melt 2 is inserted into a mold 3, for example an ingot mold. The mold 3 is formed as a two-part mold 3 having a lower part 4 and an upper part 5, which are detachably connected to one another, in the represented exemplary embodiment. Of course, the mold 3 can also have more than two parts.

Moreover, it can be provided for that a cooling channel 15, in which a coolant is led, is formed in the mold 3, in particular in the lower part 4 or in the upper part 5. Thereby, the workpiece 1 can be cooled already in the mold 3 so as to accelerate the solidification process. In particular, it can be provided for that the cooling channel 15 is formed at least in that region of the mold 3, in which an energy transmission surface 12 is to be provided on the workpiece 1.

A mold core 7, which together with the inner walls of the lower part 4 and the upper part 5 limits a mold cavity 6, is inserted into the mold 3. The metal melt 2, which particularly preferred is an aluminum melt, is inserted into the mold cavity 6. Generally, all known casting methods can be used as methods for inserting the metal melt. The method steps according to the invention have proven to be particularly advantageous in gravity ingot mold casting.

After solidification of the workpiece 1, it can be removed from the mold 3. For this purpose, the lower part 4 and the upper part 5 can be moved apart and subsequently the hot workpiece 1 can be removed from the mold 3.

In case of undercut and/or complex workpieces 1, it may also be provided for that the mold 3 consists of several parts.

At this point in time, the mold core 7 is still located in a cavity of the workpiece 1 and/or the mold core 7 can be arranged on an outer surface of the workpiece 1, and/or can extend to an outer surface of the workpiece. The hot workpiece 1 is removed from the mold 3 at a surface temperature amounting to more than 150°. In particular, a surface temperature can amount to more than 300° C., in particular between 360° and 440° C., when the workpiece 1 is removed from the mold 3. Removal of the workpiece 1 from the mold 3 can for example be carried out by means of an automatic gripper unit 8.

The hot workpiece 1 removed from the mold 3 can optionally be cooled down in a further step to a surface temperature amounting to between 150 and 400° C., depending on the removal temperature. A mist 9 of water drops can be used to cool down the workpiece 1. In this regard, the water drops vaporize as soon as they hit the hot surface of the workpiece 1. Since the workpiece 1 is in this step cooled down to a temperature significantly higher than the vaporization temperature of water, it is guaranteed that no water drops can enter the mold core 7.

Instead of the mist 9 of water drops, the workpiece 1 can also be immersed in an immersion bath for the purpose of cooling.

At this point, reference is again made to the fact that the temperatures indicated in this document refer to surface temperatures of the workpiece 1.

A determination of the surface temperature of the workpiece 1 in the mold can for example be carried out by means of temperature sensors attached in or on the mold 3 and also contactless outside of the mold 3 by means of infrared sensors. Moreover, other sensors and methods for determining the temperature known to the person skilled in the art can of course also be used. In the alternative to this, the surface temperature of the workpiece 1 can also be calculated as a mathematical model and be calculated over the temporal course.

The optional additional cooling of the workpiece 1 outside of the mold 3 only takes place until it has reached the desired temperature in a range between 300° and 400° C.

Subsequently to the removal of the workpiece 1 from the mold 3 or subsequently to the optional additional cooling of the workpiece 1 outside of the mold 3, the mold core 7 can be shattered. In the course of this, a hammer head 10 of a decoring hammer 11 is placed against an energy transmission surface 12 of the workpiece 1. In particular, in the course of this, an application surface 14 of the hammer head 10 rests against the energy transmission surface 12 of the workpiece 1. During shattering, the mold core 7 is broken, and/or at least provided with cracks.

The possible structure of a decoring hammer 11 is described in AT 513442 A1, wherein the decoring hammer 11 is referred to as vibrating hammer [Rüttelhammer] in this document.

As can well be seen from FIG. 1, the hammer head 10 of the decoring hammer 11 rests against the energy transmission surface 12 of the workpiece 1 during shattering of the mold core 7. Thereby, the energy applied by the hammer head 10 of the decoring hammer 11 is introduced into the energy transmission surface 12 of the workpiece 1, whereby the workpiece 1 is caused to vibrate and the mold core 7 is thereby shattered.

Since the workpiece 1 has a high surface temperature during this process, the solidity of the workpiece 1 is not yet entirely reached at this point in time. Thus, special demands are placed on the energy transmission surface 12 of the workpiece 1. In particular, it is required that the impact marks on the energy transmission surface 12 by the hammer head 10 are only so small that the finished workpiece 1 has no loss of function and/or no visual impairments. To achieve this, several measures can be used.

For example, it can be provided for that a surface of the workpiece 1, which has a lower surface temperature than the remaining surfaces of the workpiece 1, serves as the energy transmission surface 12. Thereby, the energy transmission surface 12 can have a higher solidity than the remaining surfaces of the workpiece 1.

The lower temperature of the energy transmission surface 12 can for example be achieved in that the energy transmission surface 12 is arranged at a bottom side 19 of the workpiece 1 in the casting position. This results from the fact that due to gravity the metal melt 2 first hits the bottom of the mold 3 and in common casting methods in which the metal melt 2 is cast into the mold from the top and is less strongly heated by the newly cast-in metal melt 2. This region can thus cool down first and form the energy transmission surface 12.

Moreover, it can be provided for that for shattering the mold core 7, the workpiece 1 is turned upside down as compared to the casting position such that the workpiece 1 rests on the support table 21 with a support side 20. In this regard, the support side 20 is formed to be opposite to the energy transmission surface 12.

In a subsequent method step, it can be provided for that the workpiece 1 is clamped in a vibrator device 13 and is caused to vibrate, wherein the mold core 7 is finally shattered and removed from the workpiece 1. In this regard, it can be provided for that the workpiece 1 is rotated about at least one horizontal axis of rotation 16 in the vibrator device 13 during simultaneous vibration. Thereby, the broken individual parts of the mold core 7 can be vibrated out of the workpiece 1. In other words, the core of the workpiece 1 is removed by this measure.

The treatment of the workpiece 1 by means of the decoring hammer 11 can be slotted in ahead of the treatment of the workpiece 1 by means of the vibrator device 13, wherein the mold core 7 can be initially broken by means of the decoring hammer 11 and can be broken into small pieces by means of the vibrator device 13, which can be conveyed out of the workpiece 1 also by means of the vibrator device 13.

A temperature has proven to be particularly advantageous for the temperature at which the core of the workpiece 1 can be removed, which corresponds with a deviation of +/−30% to a temperature at which precipitation hardening of a material of the workpiece 1 begins.

After removal of the core of the workpiece 1, it can be immersed in a tank 18 filled with a coolant 17 for further cooling.

Moreover, it can be provided for that the workpiece 1 is subsequently mechanically processed in the region of the energy transmission surface 12. In particular, a chip removing tool 22, for example a milling cutter, can be used for removing a layer of the energy transmission surface 12 and thus generate a functional surface.

As can be seen from FIG. 2, it can be provided for that a load distribution plate 23, by means of which the force applied by the hammer head 10 can be evenly applied to the energy transmission surface 12, is inserted between the hammer head 10 and the workpiece 1. By this measure, the surface pressure on the energy transmission surface 12 can be kept as low as possible, such that the workpiece 1 is not destroyed by the impact of the decoring hammer 11.

In a further embodiment, it can also be provided for that two or several decoring hammers 11 act on the load distribution plate 23. In particular, it can be provided for that the load distribution plate 23 is coupled directly to the hammer heads 10 of the individual decoring hammers 11 and does thus not have to be manipulated separately. This is particularly advantageous for duplicate parts.

FIG. 3 shows a schematic representation of a cylinder head blank 24 as well as a cylinder head 25, which is manufactured from the cylinder head blank 24 by mechanical processing.

FIG. 3 shows an engine block connecting surface 26 of the cylinder head blank 24. In the built-in state of the cylinder head 25, the engine block connecting surface 26 faces the engine block of the combustion engine and in particular lies against the engine block of the combustion engine.

FIG. 4 shows a perspective view of a decoring hammer carrier 27. The decoring hammer carrier 27 can in particular serve for holding and/or automatic movement of one or several decoring hammer(s) 11. In particular, it can be provided for that the decoring hammers 11 are arranged on an upper carriage 28, which is displaceable in the vertical direction, whereby the decoring hammers 11 can be laid against the cylinder head blank 24. It can further be provided for that the decoring hammer carrier 27 comprises a support table 21, on which the cylinder head blank 24 is placed. Moreover, it can be provided for that under the workpiece 1, in particular under the cylinder head blank 24, a buffer element 29 is arranged, which is arranged between the cylinder head blank 24 and the support table 21. The buffer element 29 can, as shown, be formed to be strip-shaped. In the alternative to this, the buffer element 29 can also be formed to be flat, wherein, also, recesses can be provided in the buffer element 29 which are permissible for the shattered mold core 7.

As can further be seen from FIG. 4, it can be provided for that the load distribution plate 23 is brought between the hammer head 10 and the workpiece 1, to decrease the surface pressure on the workpiece 1.

In particular, it is provided for in the exemplary embodiment according to FIG. 4 that the load distribution plate 23 is coupled to two hammer heads 10 of two decoring hammers 11. Of course, it is also possible that several decoring hammers 11 to which the load distribution plate 23 is coupled are provided. The coupling of the load distribution plate 23 to the hammer heads 10 of the decoring hammers 11 can for example be established via a detachable coupling.

As can be seen from a combination of FIGS. 3 and 4, it can be provided for that the engine block connecting surface 26 of the cylinder head blank 24 serves as the energy transmission surface 12. The cylinder head blank 24 can be arranged such in the mold 3 after the casting process that the engine block connecting surface 26 is arranged on the bottom side 19 of the cylinder head blank 24 in the casting position.

FIG. 5 shows a flow chart of a further possible course of the method for producing a cast workpiece 1.

As can be seen from FIG. 5, it can be provided for that the workpiece 1 is cast after preparation of the mold 3.

Subsequently, the workpiece 1 can be removed from the mold 3 in particular by means of the gripper unit 8. The removal from the mold 3 can be carried out as soon as the workpiece 1 has a surface temperature in the range of approximately 430° at the energy transmission surface 12. During manipulation of the workpiece 1, it cools down further such that the surface temperature at the energy transmission surface 12 amounts to approximately 400° C. or less at the end of the handling operation.

At this surface temperature of less than 400° C. in particular less than 360° C., the hammer head 10 of the decoring hammer 11 can be placed against the energy transmission surface 12 and it can be hammered on. After a period of 1 to 20 seconds, at least the outer parts of the mold core 7 break off such that the surface of the workpiece 1 lays bare and the workpiece 1 can cool down more quickly.

In a subsequent optional method step, the workpiece 1, in particular the energy transmission surface 12 of the workpiece 1, can be immersed in an immersion bath to quench and further cool them down.

In a subsequent method step, the workpiece 1 can be stored in a cooling shelf until the surface temperature of the energy transmission surface 12 of the workpiece 1 amounts to between 150° C. and 200° C.

Subsequently, the workpiece 1 can again the hammer head 10 of a decoring hammer 11 can again be placed against the energy transmission surface, to shatter the remaining parts of the mold core 7.

Subsequently, the workpiece 1 can be clamped in the vibrator device 13 to further shatter the mold core 7 and to remove it from the workpiece 1 in the course of this.

Subsequently, the workpiece 1 can optionally be further cooled down and be mechanically processed.

FIG. 6 shows an exemplary embodiment of a workpiece 1, which is formed as a hollow-cylindrical electric motor housing blank 30 for further processing to an electric motor housing for an electric motor. As can be seen from this exemplary embodiment, it can be provided for that the energy transmission surface 12 is formed on an end face 31 of the hollow-cylindrical electric motor housing blank 30.

In this regard, it can be provided for that the mold core 7 is formed as a partially outward core. Moreover, the mold core 7 can form the cavity of the electric motor housing blank 30. Moreover, it can be provided for that an inner mold core 7 is formed in the walls of the electric motor housing blank 30, said mold core 7 serving to form coolant channels in the electric motor housing blank.

In particular, it can be provided for that the electric motor housing blank 30 is formed as an essentially rotationally-symmetrical hollow body. Moreover, it can be provided for that the end face 31 of the hollow-cylindrical electric motor housing blank 30 is mechanically processed in a further working step.

The exemplary embodiments show possible embodiment variants, and it should be noted in this respect that the invention is not restricted to these particular illustrated embodiment variants of it, but that rather also various combinations of the individual embodiment variants are possible and that this possibility of variation owing to the teaching for technical action provided by the present invention lies within the ability of the person skilled in the art in this technical field.

The scope of protection is determined by the claims. However, the description and the drawings are to be adduced for construing the claims. Individual features or feature combinations from the different exemplary embodiments shown and described may represent independent inventive solutions. The object underlying the independent inventive solutions may be gathered from the description.

All indications regarding ranges of values in the present description are to be understood such that these also comprise random and all partial ranges from it, for example, the indication 1 to 10 is to be understood such that it comprises all partial ranges based on the lower limit 1 and the upper limit 10, i.e. all partial ranges start with a lower limit of 1 or larger and end with an upper limit of 10 or less, for example 1 through 1.7, or 3.2 through 8.1, or 5.5 through 10.

Finally, as a matter of form, it should be noted that for ease of understanding of the structure, elements are partially not depicted to scale and/or are enlarged and/or are reduced in size.

| List of reference numbers | |
|---|---|
| 1 | workpiece |
| 2 | metal melt |
| 3 | mold |
| 4 | lower part |
| 5 | upper part |
| 6 | cavity |
| 7 | mold core |
| 8 | gripper unit |
| 9 | mist |
| 10 | hammer head |
| 11 | decoring hammer |
| 12 | energy transmission surface |
| 13 | vibrator device |
| 14 | application surface of hammer head |
| 15 | cooling channel |
| 16 | axis of rotation |
| 17 | coolant |
| 18 | tank |
| 19 | bottom side |
| 20 | support side |
| 21 | support table |
| 22 | chip removing tool |
| 23 | load distribution plate |
| 24 | cylinder head blank |
| 25 | cylinder head |
| 26 | engine block connecting surface |
| 27 | decoring hammer carrier |
| 28 | upper carriage |
| 29 | buffer element |
| 30 | electric motor housing blank |
| 31 | end face |

The invention claimed is:

1. A method for producing a cast workpiece, wherein the method comprises the following method steps:

providing a mold having at least one mold core arranged in the mold;

inserting a metal melt into the mold;

waiting for a period of time until at least the outer contour of the metal melt has solidified and the workpiece has been formed from the metal melt;

removing the workpiece from the mold;

shattering the mold core, wherein this method step is carried out before the workpiece has entirely cooled down from the casting process, wherein for shattering the mold core, a hammer head is applied on a defined energy transmission surface of the workpiece and the energy transmission surface is acted on by means of the hammer head, and a surface of the workpiece serves as the energy transmission surface which has a higher solidity than other surfaces of the workpiece at the point in time at which the mold core is shattered.

2. The method according to claim 1, wherein the energy transmission surface is a surface of the workpiece which is mechanically processed in subsequent production steps.

3. The method according to claim 1, wherein a surface of the workpiece serves as the energy transmission surface which was arranged in the region of a lower part of the mold during the casting process.

4. The method according to claim 3, wherein the workpiece is turned by 180° after removal from the mold such that the energy transmission surface is located on the upper side of the workpiece and the workpiece rests on a support table on a support side opposite to the energy transmission surface.

5. The method according to claim 1, wherein the workpiece is designed as a cylinder head blank for further processing into a cylinder head for a combustion engine, wherein an engine block connecting surface of the cylinder head blank serves as the energy transmission surface.

6. The method according to claim 1, wherein the energy transmission surface is formed as a planar surface.

7. The method according to claim 1, wherein a surface area of an application surface of the hammer head or of a load distribution plate, which rests against the energy transmission surface during shattering of the mold core, amounts to between 150% and 10% of a surface area of the energy transmission surface.

8. The method according to claim 1, wherein the workpiece is removed from the mold at a surface temperature of the energy transmission surface of between 440° Celsius and 360° Celsius.

9. The method according to claim 8, wherein the workpiece is further cooled down in the ambiance while the workpiece is fed to a hammer head for shattering the mold core until the energy transmission surface has a surface temperature of between 300° Celsius and 400° Celsius.

10. The method according to claim 1, wherein shattering the mold core by means of the hammer head is carried out at a surface temperature of the energy transmission surface of between 300° Celsius and 400° Celsius, wherein at least outward parts of the mold core are shattered.

11. The method according to claim 10, wherein the hammer head acts on the workpiece with a striking action for between 1 second and 20 seconds.

12. The method according to claim 10, wherein after shattering at least of parts of the mold core, the workpiece is further cooled down until the energy transmission surface has a surface temperature of between 100° Celsius and 200° Celsius and wherein the workpiece is subsequently again fed to a hammer head for shattering of the mold core, wherein in the course of this, the remaining parts of the mold core are shattered as well.

13. The method according to claim 1, wherein the workpiece is clamped in a vibrator device after shattering of the mold core and the workpiece is rotated about at least one horizontal axis of rotation during simultaneous vibration.

14. The method according to claim 1, wherein during shattering of the mold core, several hammer heads simultaneously act on the energy transmission surface.

15. The method according to claim 1, wherein a load distribution plate is inserted between the hammer head and the energy transmission surface.

16. The method according to claim 1, wherein a cooling channel is formed in the mold, at least in the region in which the energy transmission surface of the workpiece is formed, wherein the workpiece is cooled in the region of the energy transmission surface by means of the cooling channel.

17. The method according to claim 1, wherein the energy transmission surface is locally cooled down after removal of the workpiece from the mold.

18. The method according to claim 1, wherein a feeder of the workpiece comprises the energy transmission surface.

19. The method according to claim 1, wherein the hammer head is pressed against the energy transmission surface such that during the process of shattering the mold core it continuously rests against the energy transmission surface of the workpiece also in case of a positional displacement.

20. The method according to claim 1, wherein during shattering of the mold core, the hammer head is constantly pressed against the energy transmission surface of the workpiece with a pressure force between 100 N and 2,000 N.

21. The method according to claim 1, wherein the workpiece is formed as a hollow-cylindrical electric motor housing blank for further processing to an electric motor housing, wherein an end face of the hollow-cylindrical electric motor housing blank serves as the energy transmission surface.

* * * * *